US005914631A

United States Patent [19]

Soneda

[11] Patent Number: 5,914,631

[45] Date of Patent: Jun. 22, 1999

[54] VOLTAGE GENERATING CIRCUIT

[75] Inventor: Mitsuo Soneda, Kanagawa, Japan

[73] Assignee: Sony Corporation, Japan

[21] Appl. No.: 08/905,563

[22] Filed: Aug. 4, 1997

[30] Foreign Application Priority Data

Aug. 5, 1996 [JP] Japan ..... P08-205926

[51] Int. Cl.[6] ..... G05F 1/10

[52] U.S. Cl. ..... 327/535; 327/237; 327/243

[58] Field of Search ..... 323/311, 312, 323/313; 327/231, 530, 233, 534, 234, 535, 236, 536, 237, 537, 241, 538, 243, 540, 244, 541, 245, 543, 250, 545, 252, 546, 261, 262, 263, 265, 270, 271, 273, 276, 279

[56] References Cited

U.S. PATENT DOCUMENTS 4,902,920 2/1990 Wolaver ..... 307/514
5,382,921 1/1995 Estrada et al. ..... 331/1 A
5,642,082 6/1997 Jefferson ..... 331/25
5,670,903 9/1997 Mizuno ..... 327/158
5,742,195 4/1998 Mizuno et al. ..... 327/362
5,757,238 5/1998 Ferraiolo et al. ..... 331/16

*Primary Examiner*—Timothy P. Callahan
*Assistant Examiner*—Jeffrey Zweizig
*Attorney, Agent, or Firm*—Rader, Fishman & Grauer; Ronald P. Kananen

[57] ABSTRACT

A voltage controlled delay circuit is formed by m number of gates connected in series, phases of a clock signal and a delay signal are compared by a phase comparator, an up signal or a down signal is output, an integrated signal is generated by an integrator, a voltage signal following this is generated by a buffer and fed back as an operating power source voltage to the voltage controlled delay circuit, and further an internal power source voltage following the voltage signal is generated by a buffer and a pMOS transistor, therefore the internal power source voltage of the required lowest limit can be supplied in response to the frequency of the clock and a reduction of the voltage and conservation of the electric power of the LSI circuit can be achieved.

20 Claims, 5 Drawing Sheets

VOLTAGE GENERATING CIRCUIT

BACKGROUND OF THE INVENTION

1. Field of the Invention

The present invention relates to a voltage generating circuit.

2. Description of the Related Art

In general, in an internal voltage generating circuit for generating an internal power source voltage $V_{int}$ in an integrated circuit (IC) etc., a reference voltage is generated by using for example a band gap reference power source, the internal power source voltage $V_{int}$ generated by the internal voltage generating circuit and the reference voltage are compared, and the internal power source voltage $V_{int}$ is controlled in response to the result of the comparison.

FIG. 1 is a circuit diagram of an example of a general voltage generating circuit.

As illustrated, the voltage generating circuit of the present example is constituted by a current source $I_{ext}$, a band gap reference voltage source $V_B$, buffers $BUF_1$ and $BUF_2$, and a p-type MOS transistor (hereinafter referred to as a pMOS transistor) $PT_1$.

A reference voltage $V_{ref}$, for example a constant voltage of 1.4 V, is generated from the band gap reference voltage source $V_B$ and input to an input terminal "+" of the buffer $BUF_1$. An inverting input terminal "−" of the buffer $BUF_1$ is connected to an output terminal, that is, the buffer $BUF_1$ forms a voltage follower. For this reason, a voltage signal $V_{BI}$ following the reference voltage $V_{ref}$ is output to the output terminal of the buffer $BUF_1$.

The voltage signal $V_{BI}$ output by the buffer $BUF_1$ is input to the inverting input terminal "−" of the buffer $BUF_2$, while the input terminal "+" of the buffer $BUF_2$ is connected to an output terminal $T_{vin}$ of the internal power source voltage $V_{int}$, therefore the internal power source voltage $V_{int}$ is supplied to the input terminal "+".

The output terminal of the buffer $BUF_2$ is connected to a gate of the pMOS transistor $PT_1$, a source electrode of the pMOS transistor $PT_1$ is connected to a supply line of the external power source voltage $V_{ext}$, and a drain electrode is connected to the output terminal $T_{vin}$ of the internal power source voltage $V_{int}$.

In the voltage generating circuit formed in this way, the voltage signal $V_{BI}$ output to the output terminal of the buffer $BUF_1$ from the buffer $BUF_2$ and the internal power source voltage $V_{int}$ are compared, and the level of the internal power source voltage $V_{int}$ is controlled in response to the result of the comparison.

For example, when the internal power source voltage $V_{int}$ has become higher than the voltage signal $V_{BI}$, the output voltage $V_{B2}$ of the buffer $BUF_2$ rises, an ON resistance value of the pMOS transistor $PT_1$ becomes large in response to this, and the potential of the drain electrode of the pMOS transistor $PT_2$, that is, the internal power source voltage $V_{int}$, is controlled in the downward direction.

On the other hand, when the internal power source voltage $V_{int}$ has become lower than the voltage signal $V_{BI}$, the output voltage $V_{B2}$ of the buffer $BUF_2$ is lowered, the ON resistance value of the pMOS transistor $PT_1$ becomes small, and the internal power source voltage $V_{int}$ is controlled in the upward direction.

In this way, the buffer $BUF_2$ and the pMOS transistor $PT_1$ always act so as to cancel out the fluctuation of the internal power source voltage $V_{int}$, so the internal power source voltage $V_{int}$ is held at the level of the reference voltage $V_{ref}$ set by the band gate preference voltage source $V_B$.

In the above conventional internal voltage generating circuit, however, the reference voltage $V_{ref}$ generated by the band gap reference power source and the threshold voltage $V_{th}$ of the pMOS transistor $PT_1$ have a negative temperature coefficient, so there is a problem that the internal power source voltage $V_{int}$ is lowered in response to the rise of the temperature.

Further, in an LSI circuit, the mean free path of the carriers is lowered along with a rise of the temperature, therefore the higher the temperature, the lower the speed of the LSI circuit. This is superposed on the reduction of the internal power source voltage $V_{int}$ due to the temperature characteristic, so a large design margin is necessary.

SUMMARY OF THE INVENTION

The present invention was made in consideration with such a circumstance and has an object thereof to provide a voltage generating circuit capable of greatly reducing the design margin regardless of the fluctuation of the temperature and external voltage and generating an operating power source voltage of the required lowest limit at a predetermined clock frequency.

To attain the above object, the present invention provides a voltage generating circuit for supplying a predetermined power source voltage to a logical circuit in response to the frequency of an input clock signal, having a variable delay circuit for delaying the input clock signal by a delay time in response to the operating power source voltage; a phase comparison circuit for performing a comparison of phases of the clock signal delayed by the variable delay circuit and the input clock signal; and a voltage generating means for adjusting the level of the output voltage in response to the result of comparison of the phase comparison circuit and supplying the output voltage as the operating power source voltage of the variable delay circuit.

Further, in the present invention, the variable delay circuit uses the output voltage of the voltage generating means as the operating power source voltage and is constituted by m number (m is an integer) of gate circuits connected in series. This integer m is set to larger than the maximum design number of gates l (l is an integer) of the logic circuit to which the output voltage of the voltage generating means is supplied.

Further, in the present invention, the voltage generating means is constituted by an integrator for controlling the output voltage in response to the result of comparison from the comparison circuit or by a counting means for setting a count in response to the result of comparison from the phase comparison circuit and a digital/analog converting means for outputting a voltage signal in response to the count of the counting means.

Further, in the present invention, provision is made, between the variable delay circuit and the phase comparison circuit, of a fixed delay circuit for further delaying the signal delayed by the variable delay circuit and inputting the same to the phase comparison circuit.

According to the present invention, there is further provided a voltage generating circuit for supplying a predetermined voltage to a supplied circuit in response to a frequency of an input clock signal, having a variable delay circuit for delaying the input clock signal by exactly a delay time in response to an operating power source voltage; a phase comparison circuit performing a comparison of phases of the clock signal delayed by the variable delay circuit and the input clock signal; and a voltage generating means for adjusting the level of the output voltage in response to the result of comparison of the phase comparison circuit and supplying the output voltage as the operating power source voltage of the variable delay circuit.

According to the present invention, the clock signal is delayed by a variable delay circuit which gives a delay time controlled in response to the operating power source voltage and is input as a comparison signal to the phase comparison circuit. The clock signal also is input as it is to the phase comparison circuit as a reference signal. For example, an up signal or a down signal is output by the phase comparison circuit in response to the phase difference between the comparison signal and the reference signal. A voltage signal in response to the up signal or the down signal is generated by the voltage generating means.

The output signal of the voltage generating means is input to the variable delay circuit as the operating power source voltage, the delay time of the variable delay circuit is controlled in response to this, and an internal power source voltage following the voltage output by the voltage generating means is generated via the buffer circuit and supplied to a supplied circuit, for example, an LSI circuit.

By this, a voltage generating circuit capable of generating an operating power source voltage of the required lowest limit at the predetermined clock frequency regardless of the fluctuation of the temperature and external voltage, achieving a reduction of voltage and conservation of electric power of the LSI circuit, and greatly reducing the design margin can be realized.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

First Embodiment

Figure 1:
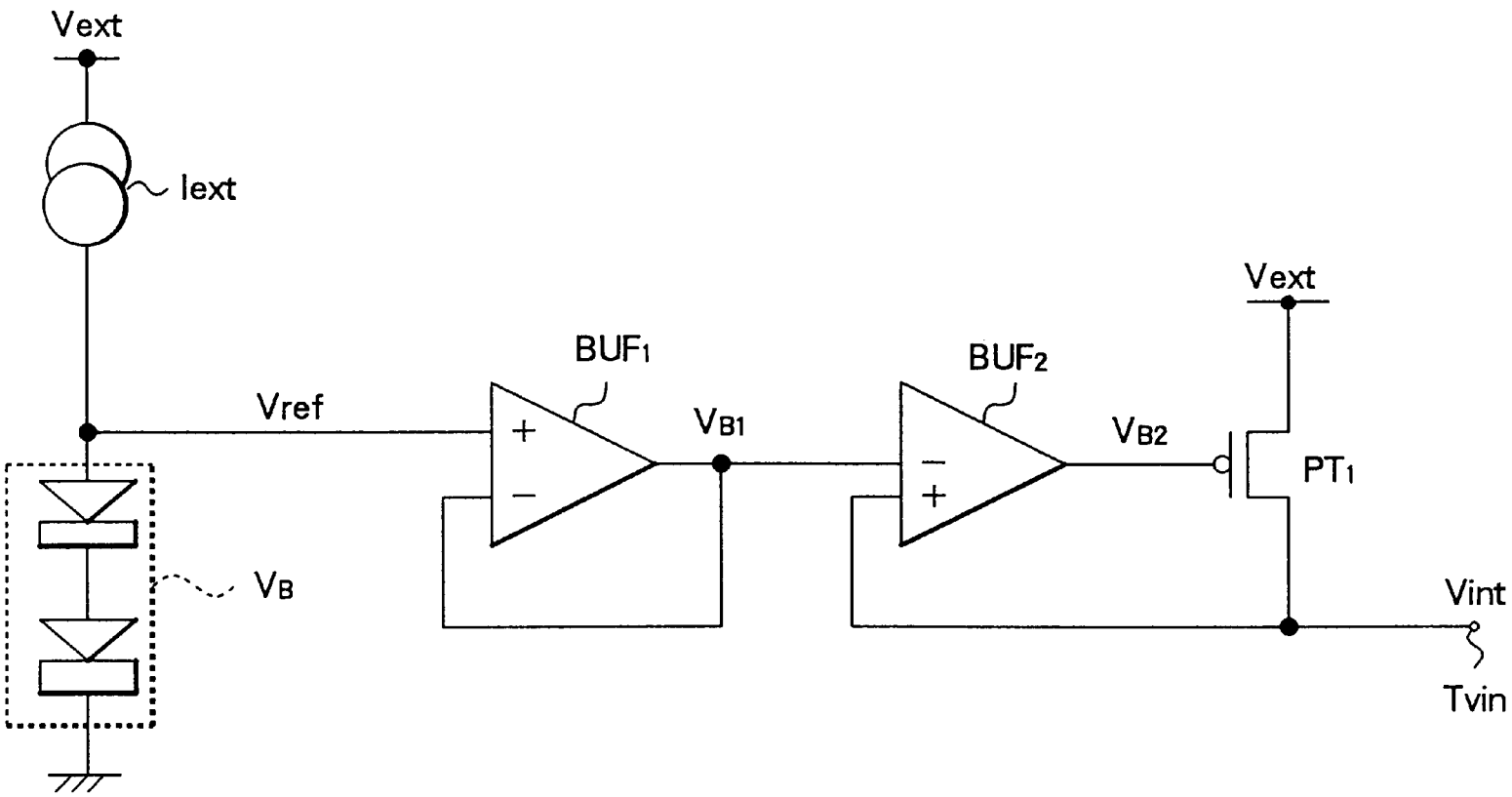
PRIOR ART FIG. 1
FIG. 1 is a circuit diagram of an example of a general voltage generating circuit.
Figure 2:
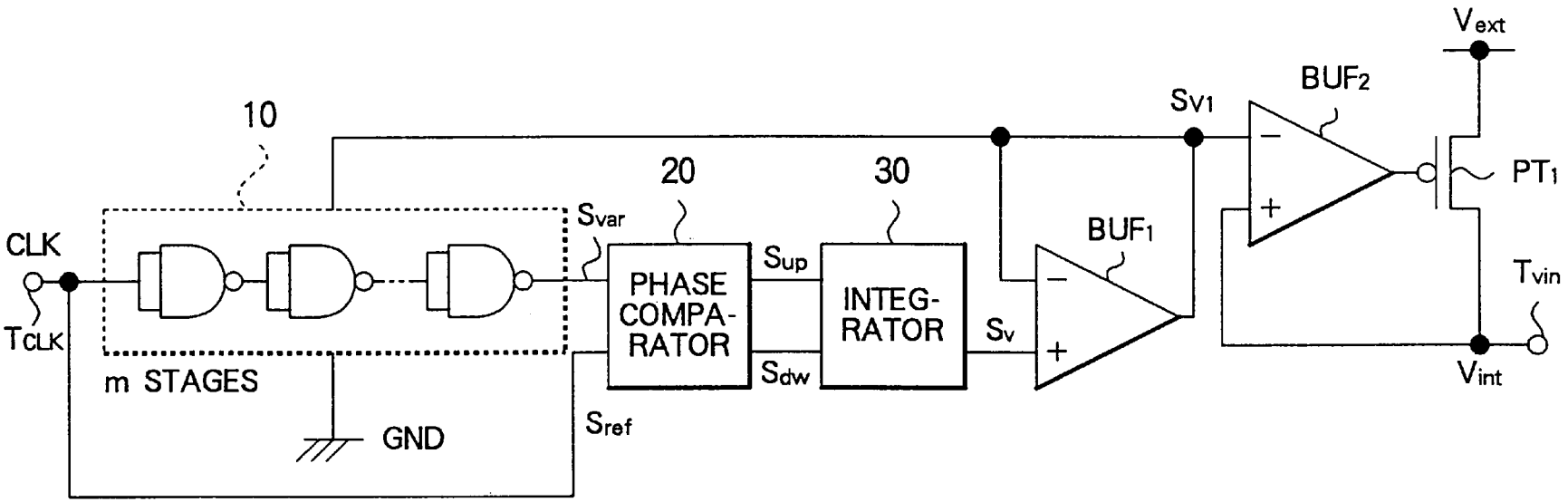
FIG. 2 is a generating diagram of a first embodiment of a voltage generating circuit according to the present invention.
Figures 3A, 3B, 3C, 3D, 3E:
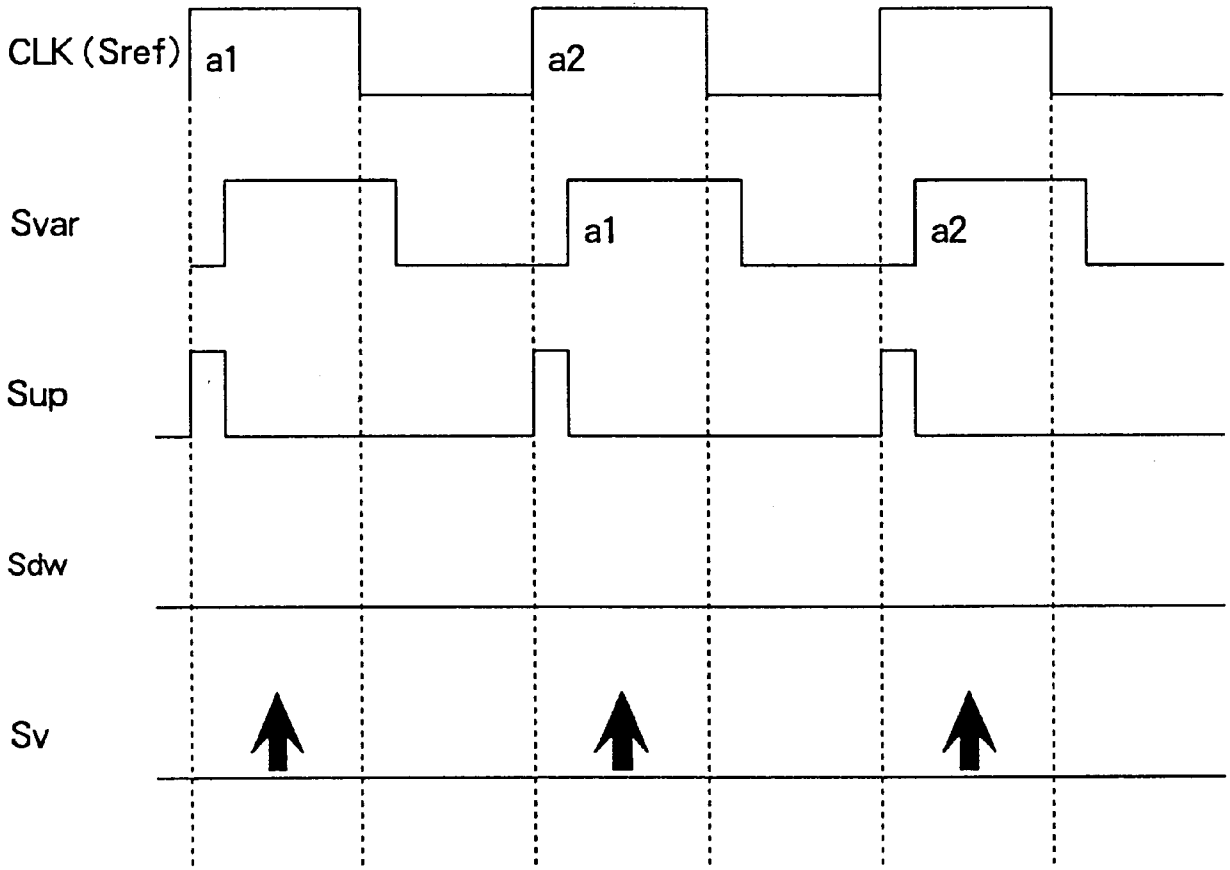
FIGS. 3A to 3E are timing charts of the voltage generating circuit shown in FIG. 1.

FIG. 2 is a circuit diagram of a first embodiment of a voltage generating circuit according to the present invention.

As illustrated, the voltage generating circuit of the present embodiment is constituted by a voltage controlled delay circuit 10, a phase comparison 20, an integrator 30, buffers $BUF_1$ and $BUF_2$, and a p-type MOS transistor $PT_1$.

The voltage controlled delay circuit 10 is constituted by m number of NAND gates $NA_1, NA_2, \ldots, NA_m$. These NAND gates are connected in series. The input terminal of a later NAND gate is connected to the output terminal of the earlier NAND gate, the input terminal of the initial NAND gate $NA_1$ is connected to the input terminal $T_{CLK}$ of a system clock signal CLK, and the output terminal of the last NAND gate $NA_m$ is connected to the input terminal of the comparison signal $S_{var}$ of the phase comparator 20.

In this way, the phase of the clock signal CLK input to the voltage controlled delay circuit 10 is delayed by the m number of NAND gates $NA_1, NA_2, \ldots, NA_m$ and then the delayed signal is input as the comparison signal $S_{var}$ to the phase comparator 20.

Further, the reference signal input terminal of the phase comparator 20 is connected to the input terminal $T_{CLK}$ of the clock signal CLK. Namely, the clock signal CLK is input as the reference signal $S_{ref}$ to the phase comparator 20.

The phase comparator 20 compares the phases of the clock signal CLK serving as the reference signal $S_{ref}$ and the comparison signal $S_{var}$ from the voltage controlled delay circuit 10, generates the up signal $S_{up}$ or the down signal $S_{dw}$ in response to the result of the comparison, and outputs the same to the integrator 30.

The integrator 30 receives the up signal $S_{up}$ or the down signal $S_{dw}$ from the phase comparator 20, performs the integration in response to these signals to generate the integrated signal $S_V$, and outputs this to the buffer $BUF_1$.

The input terminal "+" of the buffer $BUF_1$ is connected to the output terminal of the integrator 30, while the inverting input terminal "−" is connected to the output terminal. Namely, a voltage follower is formed by the buffer $BUF_1$. For this reason, a signal $S_{V1}$ of the same level as that of the integrated signal $S_V$ output from the integrator 30 is output from the output terminal of the buffer $BUF_1$.

Further, the output signal $S_{V1}$ of the buffer $BUF_1$ is supplied as the operating power source voltage of the voltage controlled delay circuit 10 to the voltage controlled delay circuit 10.

The inverting input terminal "−" of the buffer $BUF_2$ is connected to the output terminal of the buffer $BUF_1$, while the output terminal of the buffer $BUF_2$ is connected to the gate of the pMOS transistor $PT_1$. The source electrode of the pMOS transistor $PT_1$ is connected to the supply lien of the external power source voltage $V_{ext}$, while the drain electrode is connected to the output terminal $T_{vin}$ of the internal power source voltage $V_{int}$.

Further, the input terminal "+" of the buffer $BUF_2$ is connected to the output terminal $T_{vin}$.

In this way, the pMOS transistor $PT_1$ operates as the driver of the internal power source voltage $V_{int}$, while the internal power source voltage $V_{int}$ output to the output terminal $T_{vin}$ follows the voltage $S_{V1}$ input to the inverting input terminal "−" of the $BUF_2$ by the action of the buffer $BUF_2$ and the pMOS transistor $PT_1$. Namely, the internal power source voltage $V_{int}$ follows the integrated signal $S_V$ output from the integrator 30.

The internal power source voltage $V_{int}$ is for example supplied to an LSI circuit formed on a semiconductor chip.

Below, an explanation will be made of the operation of the voltage generating circuit having the configuration explained above by referring to FIG. 2.

The number m of the NAND gates constituting the voltage controlled delay circuit 10 is set to larger than for example the maximum design number of gates of the LSI circuit which is supplied with the internal power source voltage $V_{int}$. Further, the operating power source voltage of the voltage controlled delay circuit 10 is the output signal $S_{V1}$ of the buffer $BUF_1$ and has the same level as that of the internal power source voltage $V_{int}$. For this reason, the delay time produced by the voltage controlled delay circuit 10 always becomes larger than the maximum delay time of the LSI circuit.

Here, for example, when assuming that the delay time of each of the NAND gates constituting the voltage controlled delay circuit 10 is $T_{pd}$, the delay time $T_{D1}$ of the voltage Controlled delay circuit 10 is found from the following equation:

$$T_{D1}=m\cdot T_{pd} \quad (1)$$

Note that, if the maximum value of the number of the gate stages of the LSI circuit is set to l so that the maximum delay time of the LSI circuit which is supplied with the internal power source voltage $V_{int}$ becomes within one cycle of the clock signal, the number m of the NAND gates constituting the voltage controlled delay circuit 10 is set so as to satisfy the following equation as mentioned above:

$$m>l \quad (2)$$

If the number m of the NAND gates constituting the voltage controlled delay circuit 10 is set in this way, in the LSI circuit, a required operation is carried out in one cycle of the clock signal CLK.

The phase comparator 20 compares the phase of the comparison signal $S_{var}$ output by the voltage controlled delay circuit 10 and the phase of the clock signal CLK and outputs the up signal $S_{up}$ or the down signal $S_{dw}$ to the integrator 30 in response to the result of comparison.

For example, when the phase of the clock signal CLK used as the reference signal $S_{ref}$ is advanced, the up signal $S_{up}$ is output by the phase comparator 20, while when the phase of the clock signal CLK is delayed, the down signal $S_{dw}$ is output from the phase comparator 20.

The integrator 30 outputs an integrated signal $S_V$ in response to the up signal $S_{up}$ or the down signal $S_{dw}$ from the phase comparator 20. For example, when an up signal $S_{up}$ is received from the phase comparator 20, it is controlled so that the voltage of the integrated signal $S_V$ rises, while when the down signal $S_{dw}$ is received from the phase comparator 20, it is controlled so that the voltage of the integrated signal $S_V$ is lowered.

The buffer $BUF_1$ constituting the voltage follower outputs the voltage signal $S_{V1}$ of the same level as that of the integrated signal $S_V$ input to the input terminal "+". The voltage signal $S_{V1}$ is supplied as the operating power source voltage of the voltage controlled delay circuit 10, therefore when the phase of the output signal $S_{var}$ of the voltage controlled delay circuit 10 is delayed from the clock signal CLK, the up signal $S_{up}$ is output by the phase comparator 20, and it is controlled so that the voltage level of the integrated signal $S_V$ and the output signal $S_{V1}$ of the buffer $BUF_1$ rises. By the rise of the operating power source voltage of the voltage controlled delay circuit 10, the delay time of the NAND gates constituting the voltage controlled delay circuit 10 is shortened, and an adjustment is made so that the phase delay of the output signal $S_{var}$ of the voltage controlled delay circuit 10 is reduced.

The output signal $S_{V1}$ of the buffer $BUF_1$ is input to the buffer $BUF_2$. By the action of the buffer $BUF_2$ and the pMOS transistor $PT_1$, the internal power source voltage $V_{int}$ output to the output terminal $T_{vin}$ follows the integrated signal $S_V$ output by the integrator 30. By this, control is performed so as to reduce the maximum delay time of the LSI circuit using the internal power source voltage $V_{int}$ as the operating power source voltage in the same was as the voltage controlled delay circuit 10.

On the other hand, where the phase of the comparison signal $S_{var}$ from the voltage controlled delay circuit 10 is advanced from the phase of the clock signal CLK used as the reference signal $S_{ref}$, the down signal $S_{dw}$ is output by the phase comparator 20. In response to this, the down signal $S_{dw}$ is output by the phase comparator 20, and control is performed so that the voltage of the integrated signal $S_V$ output by the integrator 30 is lowered.

In response to this, the voltage of the voltage signal $S_{V1}$ output from the buffer $BUF_1$ is lowered following the integrated signal $S_V$ and is supplied to the voltage controlled delay circuit 10 as the operating power source voltage, therefore control is performed so that the delay time $T_{D1}$ of the voltage controlled delay circuit 10 is increased, and the phase of the comparison object signal $S_{var}$ output to the phase comparator 20 is delayed. The phase becomes stable when its coincides with that of the clock signal CLK.

The level of the internal power source voltage $V_{int}$ supplied to the LSI circuit as the operating power source voltage is lowered as well as mentioned above, and the maximum delay time of the LSI circuit is held to within one cycle of the clock signal CLK.

In this way, by the voltage generating circuit of the present invention, the internal power source voltage $V_{int}$ of the required lowest limit for holding the delay time of the clock signal CLK produced in the LSI circuit within a predetermined range, for example, an amount of one cycle of the system clock signal CLK, is supplied to the LSI circuit. For example, in an LSI circuit in which the frequency of the system clock signal is switched in response to the operation mode, in response to the frequency of each clock signal, the internal power source voltage $V_{int}$ of the required lowest limit for holding the delay time of the circuit within the constant range is supplied, thus a reduction of the voltage and conservation of the electric power of the LSI circuit can be achieved.

Further, a fluctuation of the delay time of the LSI circuit due to a temperature change etc. can be automatically coped with by the voltage generating circuit, so the level of the internal power source voltage $V_{int}$ is controlled so that the delay time of the circuit is always held constant. By this, the design margin of the LSI circuit can be greatly reduced.

FIGS. 3A to 3E are timing charts of the voltage generating circuit shown in FIG. 2.

As illustrated, when the phase of the output signal $S_{var}$ of the voltage controlled delay circuit 10 is delayed due to the input clock signal CLK, the up signal $S_{up}$ is output by the phase comparator 20 and control is period so that the potential of the integrated signal $S_V$ output from the integrator 30 rises in response to this.

The voltage signal $S_{V1}$ following the integrated signal $S_V$ is fed back to the voltage controlled delay circuit 10 as the operating power source voltage of the voltage controlled delay circuit 10. The delay time $T_{D1}$ of the voltage controlled delay circuit 10 is controlled in response to the level of the voltage signal $S_{V1}$.

For example, as shown in FIGS. 3A to 3E, when the phase of the comparison object signal $S_{var}$ delayed by the voltage controlled delay circuit 10 is delayed from the clock signal CLK by an amount of one cycle or more, the up signal $S_{up}$ is output by the phase comparator 20 and the control is performed so that the level of the integrated signal $S_V$ rises by the integrator 30 in response to this, therefore control is performed so that the level of the voltage signal $S_{V1}$ also rises in response to this.

It becomes stable when the phase of the output signal $S_{var}$ of the voltage controlled delay circuit 10 and the phase of the clock signal CLK become the same, that is, the phase lag of the output signal $S_{var}$ of the voltage controlled delay circuit 10 from the clock signal CLK becomes one cycle of the clock signal CLK.

The internal power source voltage $V_{int}$ is generated in response to the integrated signal $S_V$ and supplied to the LSI circuit, therefore the internal power source voltage $V_{int}$ of the required lowest limit for holding the delay time of the LSI circuit within the constant range, for example, within one cycle of the clock signal CLK in the present example, is supplied.

In this way, the level of the internal power source voltage $V_{int}$ is controlled by a feedback circuit constituted by the voltage controlled delay circuit 10, the phase comparator 20, and the integrator 30, therefore in an LSI circuit operating by using the internal power source voltage $V_{int}$ as the operating power source voltage, the required computations can be carried out within one cycle of the clock signal CLK when operating with the maximum design number of gates l. For example, even when the frequency of the clock signal CLK is switched, the internal power source voltage $V_{int}$ of the required lowest limit is always supplied to the LSI circuit in response to the clock signal CLK.

Further, the internal power source voltage $V_{int}$ of the required lowest limit is supplied to the LSI circuit by the above feedback circuit with respect to the fluctuation of the temperature, process, or external power source voltage $T_{ext}$.

As explained above, according to the present embodiment, the voltage controlled delay circuit 10 is formed by m number of NAND gates connected in series, the phase of the signal $S_{var}$ delayed at the voltage controlled delay circuit 10 and the phase of the clock signal CLK are compared by the phase comparator 20, the up signal $S_{up}$ or the down signal $S_{dw}$ is output in response to the result of the comparison, and the integrated signal $S_V$ is generated by the integrator 30 in response to these signals. The signal $S_{V1}$ following the integrated signal $S_V$ is generated by the buffer $BUF_1$ and is fed back to the voltage controlled delay circuit 10 as the operating power source voltage of the voltage controlled delay circuit 10. Further, the internal power source voltage $V_{int}$ following the signal $S_{V1}$ is generated by the buffer $BUF_2$ and the pMOS transistor $PT_1$ and is output to the output terminal $T_{vin}$, therefore the internal power source voltage $V_{int}$ of the required lowest limit for holding the maximum delay time of the LSI circuit within the predetermined range is supplied in response to the frequency of the clock signal CLK, a reduction of the voltage and conservation of electric power of the LSI circuit can be achieved, and a reduction of the design margin can be realized.

Second Embodiment

Figure 4:
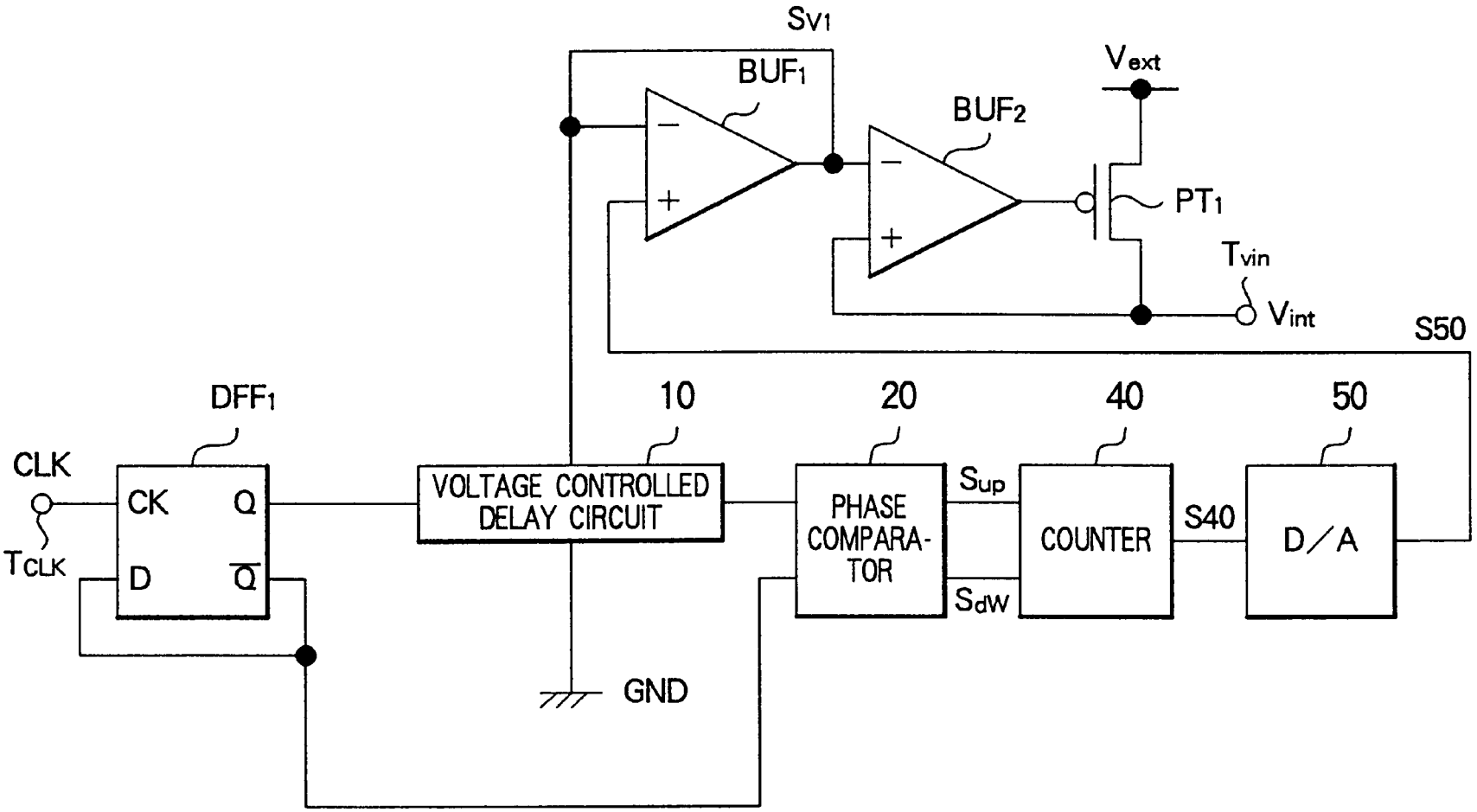
FIG. 4 is a circuit diagram of a second embodiment of the voltage generating circuit according to the present invention.

FIG. 4 is a circuit diagram of a second embodiment of the voltage generating circuit according to the present invention.

As shown in FIG. 4, the voltage generating circuit of the present embodiment is constituted by a flip-flop $DFF_1$, a voltage controlled delay circuit 10, a phase comparator 20, a counter (counting means) 40, a digital/analog converter (D/A) 50, buffers $BUF_1$ and $BUF_2$, and a pMOS transistor $PT_1$.

The clock signal input terminal CK of the flip-flop $DFF_1$ is connected to the input terminal of the clock signal CLK, the output terminal is connected to the input terminal of the voltage controlled delay circuit 10, and the inverting output terminal is connected to the input terminal and further connected to the input terminal of the reference signal $S_{ref}$ of the phase comparator 20.

The output terminal of the voltage controlled delay circuit 10 is connected to the input terminal of the comparison signal $S_{var}$ of the phase comparator 20.

The phase comparator 20 compares the phases of the comparison signal $S_{var}$ from the voltage controlled delay circuit 10 and the reference signal $S_{ref}$ from the flip-flop $DFF_1$, generates the up signal $S_{up}$ or the down signal $S_{dw}$ in response to the result of the comparison, and outputs the same to the counter 40.

The counter 40 performs a count up or a count down counting operation in response to the up signal $S_{up}$ or down signal $S_{dw}$ from the phase comparator 20, generates the count value S40, and outputs this to the digital/analog converter 50.

The digital/analog converter 50 generates a voltage signal S50 in response to the count value S40 from the counter 40 and outputs this to the buffer $BUF_1$.

The buffer $BUF_1$ constitutes a voltage follower, generates a voltage signal $S_{V1}$ following the voltage signal S50 from the digital/analog converter 50, and outputs this to the buffer $BUF_2$. The $BUF_2$ and the pMOS transistor $PT_1$ generate the internal power source voltage $V_{int}$ following the input voltage signal $S_{V1}$ and outputs this to the output terminal $T_{vin}$.

Further, the voltage signal $S_{V1}$ generated by the buffer $BUF_1$ is supplied as the operating power source voltage of the voltage controlled delay circuit 10 to the voltage controlled delay circuit 10.

Below, an explanation will be made of the operation of the voltage generating circuit of the second embodiment.

As shown in FIG. 4, the flip-flop $DFF_1$ constitutes a frequency dividing circuit, the input clock signal CLK is divided in frequency into two, the divided signal is input to the voltage controlled delay circuit 10 and delayed by the voltage controlled delay circuit 10, and the thus obtained signal is input as the comparison signal $S_{var}$ to the phase comparator 20.

On the other hand, the inverted signal of the divided signal output from the inverting output terminal of the flip-flop $DFF_1$ is input as the reference signal $S_{ref}$ to the phase comparator 20.

The phase comparator 20 compares the phase of the comparison signal $S_{var}$ output from the voltage controlled delay circuit 10 and the phase of the reference signal $S_{ref}$ from the flip-flop $DFF_1$ and outputs the up signal $S_{up}$ or the down signal $S_{dw}$ to the counter 40 in response to the result of the comparison.

For example, where the phase of the clock signal CLK used as the reference signal $S_{ref}$ is advanced, the up signal $S_{up}$ is output by the phase comparator 20, and conversely, where the phase of the clock signal CLK is delayed, the down signal $S_{dw}$ is output by the phase comparator 20.

The counter 40 performs a count up or a count down counting operation in response to the up signal $S_{up}$ or the down signal $S_{dw}$ from the phase comparator 20 and outputs the count value S40 to the digital/analog converter 50.

The digital/analog converter 50 generate a voltage signal S50 in response to the count value S40 form the counter 40 and outputs it to the buffer $BUF_1$.

The operations of the constituent parts of the buffers $BUF_1$ and $BUF_2$ and the pMOS transistor $PT_1$ are similar to the operations of the first embodiment shown in FIG. 2, so a detailed explanation thereof is omitted here.

By this part, an internal power source voltage $V_{int}$ following the voltage signal S50 generated by the digital/analog converter 50 is generated and output to the output terminal $T_{vin}$.

In this way, the level of the internal power source voltage $V_{int}$ is controlled by a feedback circuit constituted by the frequency dividing circuit made of the flip-flop $DFF_1$, the voltage controlled delay circuit 10, the phase comparator 20, and the integrator 30, and the control is performed so that the delay time of the voltage controlled delay circuit 10 becomes a half cycle of the frequency-divided signal, that is, the amount of one cycle of the clock signal CLK. Therefore, in an LSI circuit operating by using the internal power source voltage $V_{int}$ as the operating power source voltage, the required computations can be carried out within one cycle of the clock signal CLK when operating with the maximum design number of gates.

Note that, in FIG. 4, it goes without saying that a voltage signal in response to the output signal of the phase comparator 20 can be generated by using the integrator 30 as shown in FIG. 2 in place of the counter 40 and the digital/analog converter 50.

As explained above, according to the present embodiment, a frequency dividing circuit is formed by the flip-flop $DFF_1$, the voltage controlled delay circuit 10 is formed by m number of NAND gates connected in series, phases of the frequency-divided signal delayed at the voltage controlled delay circuit 10 used as the comparison signal $S_{var}$ and the clock signal CLK used as the reference signal $S_{ref}$ are compared at the phase comparator 20, the up signal $S_{up}$ or the down signal $S_{dw}$ is output in response to the result of the comparison, the count value S40 is generated by the counter 40 in response to these signals, the voltage signal S50 is output by the digital/analog converter 50, the signal $S_{V1}$ following the voltage signal S50 is generated by the buffer $BUF_1$ and fed back to the voltage controlled delay circuit 10 as the operating power source voltage of the voltage controlled delay circuit 10, and further the internal power source voltage $V_{int}$ following the signal $S_{V1}$ is generated by the buffer $BUF_2$ and the pMOS transistor $PT_1$ and output to the output terminal $T_{vin}$, therefore the internal power source voltage $V_{int}$ of the required lowest limit for holding the delay time of the LSI circuit within the predetermined range is supplied in response to the frequency of the clock signal CLK, a reduction of voltage and conservation of electric power of the LSI circuit can be achieved, and a reduction of the design margin can be realized.

Third Embodiment

Figure 5:
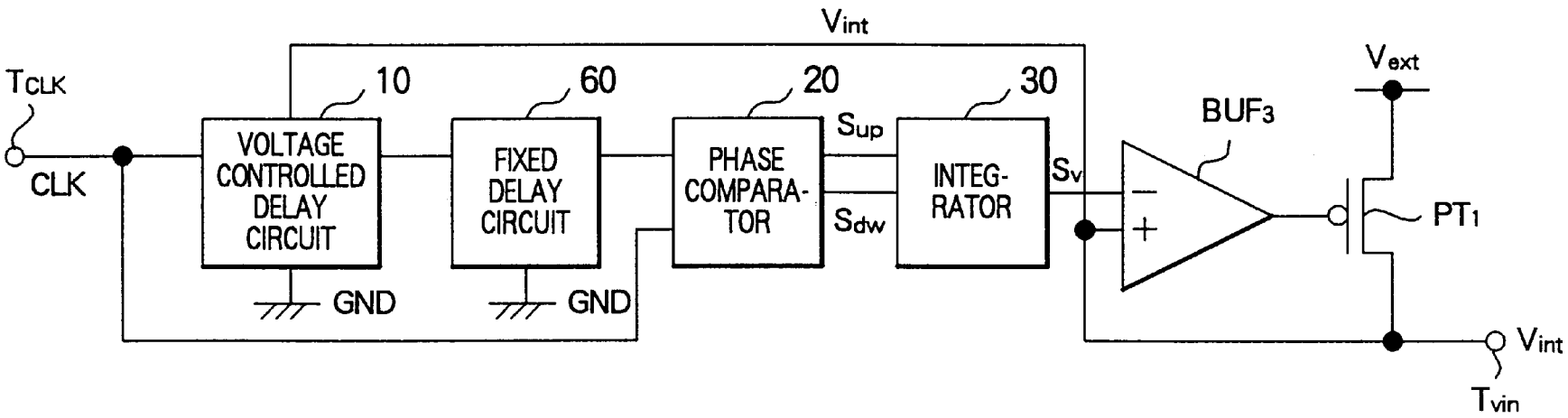
FIG. 5 is a circuit diagram of a third embodiment of the voltage generating circuit according to the present invention.

FIG. 5 is a circuit diagram of a third embodiment of the voltage generating circuit according to the present invention.

As illustrated, the voltage generating circuit of the present embodiment is constituted by a voltage controlled delay circuit 10, a phase comparator 20, an integrator 30, a fixed delay circuit 60, a buffer $BUF_3$, and a pMOS transistor $PT_1$.

In the present embodiment, the constituent parts of the voltage controlled delay circuit 10, the phase comparator 20, and the integrator 30 are similar to those of the first embodiment of the present invention shown in FIG. 2, so as detailed explanation of these constituent parts is omitted here. Below, the explanation will be made of only the parts different from those of the first embodiment by referring to FIG. 5.

The fixed delay circuit 60 is constituted by, for example an RC circuit formed on a substrate, more specifically is constituted by an RC circuit equivalent to a critical path (maximum delay path) of the LSI circuit as the supplied circuit of the voltage generating circuit, and gives a fixed delay time $T_{D2}$ to the input signal.

Alternatively, the fixed delay circuit 60 is constituted by a flip-flop having a delay time equivalent to the delay time of the critical path.

As shown in FIG. 5, the input terminal of the fixed delay circuit 60 is connected to the output terminal of the voltage controlled delay circuit 10, while the output terminal is connected to the input terminal of the comparison signal $S_{var}$ of the phase comparator 20.

The reference signal input terminal of the phase comparator 20 is connected to the input terminal $T_{CLK}$ of the clock signal CLK. The up signal $S_{up}$ or the down signal $S_{dw}$ generated by the phase comparator 20 are respectively input to the generator 30. The integrator 30 generates the integrated signal $S_V$ in response to these signals and inputs this to the inverting input terminal "−" of the buffer $BUF_3$.

The output terminal of the buffer $BUF_3$ is connected to the gate electrode of the pMOS transistor $PT_1$, the source electrode of the pMOS transistor $PT_1$ is connected to the supply line of the external power source voltage $V_{ext}$, and the drain electrode is connected to the output terminal $T_{vin}$ of the internal power source voltage $V_{int}$.

The input terminal "+" of the buffer $BUF_3$ is connected to the output terminal $T_{vin}$ of the internal power source voltage $V_{int}$.

Further, the internal power source voltage $V_{int}$ is supplied as the operating power source voltage of the voltage controlled delay circuit 10 to the voltage controlled delay circuit 10.

Below, an explanation will be made of the operation of the present embodiment by referring to FIG. 5.

The clock signal CLK is input to the voltage controlled delay circuit 10, whereby a delay time $T_{D1}$ is given to it. The signal is then input to the fixed delay circuit 60, where the fixed delay circuit 60 gives a delay time $T_{D2}$. The resultant signal is then output as the comparison signal $S_{var}$ to the phase comparator 20.

On the other hand, the clock signal CLK is input as it is as the reference signal $S_{ref}$ to the phase comparator 20.

The phase comparator 20 compares the phases of the comparison signal $S_{var}$ given the delay time and the clock signal CLK used as the reference signal $S_{ref}$, generates the up signal $S_{up}$ or the down signal $S_{dw}$ in response to the result of the comparison, and outputs the result to the integrator 30.

The integrator 30 generates the integrated signal $S_V$ in response to the up signal $S_{up}$ or the down signal $S_{dw}$ from the phase comparator 20 and input it to the inverting input terminal "−" of the buffer $BUF_3$.

The internal power source voltage $V_{int}$ is generated by the driving pat constituted by the buffer $BUF_3$ and the pMOS transistor $PT_1$ and output to the output terminal $T_{vin}$.

The pMOS transistor $PT_1$ operates as the driver of the internal power source voltage $V_{int}$. By this, the level of the internal power source voltage $V_{int}$ is controlled in response to the level of the output signal of the buffer $BUF_3$ and always follows the level of the integrated signal $S_V$ output by the integrator 30.

In the present embodiment, the delay time $T_{D1}$ generated by the voltage controlled delay circuit 10 is controlled by the level of the operating power source voltage of the voltage controlled delay circuit 10, that is, the internal power source voltage $V_{int}$ output to the output terminal $T_{vin}$.

On the other hand, the fixed delay time $T_{D2}$ generated by the fixed delay circuit 60 is set to a delay time equivalent to the delay time of the critical path as mentioned above.

The voltage controlled delay circuit 10 is constituted by for example m number of NAND gates similar to the first embodiment shown in FIG. 2. If for example the delay time $T_{pd}$ is given by each NAND gate, the delay time $T_{D1}$ of the voltage controlled delay circuit 10 may be found by equation (1) shown in the first embodiment, namely, ($T_{D1}$=m·$T_{pd}$).

Note that, similar to the first embodiment, the number m of the NAND gates constituting the voltage controlled delay circuit 10 is set so that m becomes larger than l if the design maximum value of the number of gates of the LSI circuit which is supplied by the internal power source voltage $V_{int}$ is l, that is, in the LSI circuit, the required operation is carried out within one cycle of the clock signal CLK.

The delay time $T_{D2}$ given by the fixed delay circuit 60 is set similar to the delay time produced by the critical path of circuit in the LSI circuit.

In this way, the delay circuit part in the present embodiment is constituted by the voltage controlled delay circuit 10 used as the variable delay circuit and the fixed delay circuit 60.

The variable delay circuit is constituted similar to the voltage controlled delay circuit shown in the first and second embodiment. The delay time $T_{D1}$ is controlled in response to the operating power source voltage.

On the other hand, the fixed delay circuit 60 is constituted by for example RC circuits. The delay time $T_{D2}$ is set in response to the delay time produced by the critical path of the LSI circuit which is supplied with the internal power source voltage $V_{int}$.

Note that, here, the delay time $T_{D2}$ of this fixed delay circuit is set in response to the delay time produced by the LSI circuit critical path and can be set within one cycle of the system clock signal CLK or more than one cycle.

Note that, in FIG. 5, it goes without saying that a voltage signal in response to the output signal of the phase comparator 20 can be generated by using the counter 40 and the digital/analog converter 50 shown in FIG. 4 in place of the integrator 30.

Further, it goes without saying that, as shown in FIG. 4, the voltage signal $S_{V1}$ following the integrated signal $S_V$ can generated by a voltage follower constituted by the buffer $BUF_1$ in place of the buffer $BUF_3$ and the pMOS transistor $PT_1$, this can be fed back as the operating power source voltage to the voltage controlled delay circuit 10, and further the internal power source voltage $V_{int}$ following the voltage signal $S_{V1}$ can be generated by the buffer $BUF_2$ and the pMOS transistor $PT_1$.

As explained above, according to the present embodiment, the voltage controlled delay circuit 10 is constituted by m number of NAND gates connected in series, the fixed delay circuit 60 is provided, the phases of the signal $S_{var}$ delayed by the voltage controlled delay circuit 10 and the fixed delay circuit 60 and the clock signal CLK are compared, the up signal $S_{up}$ or the down signal $S_{dw}$ is output in response to the result of comparison, and the integrated signal $S_V$ is generated by the integrator 30 in response to these signals. The internal power source voltage $V_{int}$ following the integrated signal $S_V$ is generated by the buffer $BUF_3$, fed back as the operating power source voltage to the voltage controlled delay circuit 10, and further output to the output terminal $T_{vin}$, therefore the internal power source voltage $V_{int}$ of the required lowest limit for holding the delay time of the LSI circuit in response to the frequency of the clock signal CLK within the predetermined range is supplied, a reduction of the voltage and conservation of electric power of the LSI circuit can be achieved, and a reduction of the design margin can be realized.

As explained above, according to the voltage generating circuit of the present invention, there is an advantage that the operating power source voltage of the required lowest limit at the predetermined clock frequency can be generated regardless of the fluctuation of the temperature and the external voltage, and the design margin can be greatly reduced.

Further, according to the present invention, there are advantages that the operating power source voltage of the required lowest limit can be generated in response to the frequency of the system clock and a reduction of voltage and conservation of electric power of the LSI circuit can be achieved.

While the invention has been described by reference to specific embodiments chosen for purposes of illustration, it should be apparent that numerous modifications could be made thereto by those skilled in the art without departing from the basic concept and scope of the invention.

What is claimed is:

1. A voltage generating circuit for supplying an adjusted operational power source voltage to a supplied circuit in response to a frequency of an input clock signal, comprising:

a variable delay circuit for delaying the input clock signal by exactly a delay time in response to a first output voltage;

a phase comparison circuit performing a comparison of phases of the clock signal delayed by said variable delay circuit and said input clock signal; and a voltage generating means for adjusting the level of a second output voltage in response to the result of comparison of said phase comparison circuit, said voltage generating means including a first buffer circuit which generates said first output voltage following the result of said phase comparison circuit and supplies the first output voltage as the operating power source voltage to said variable delay circuit, and a second buffer circuit which generates said second output voltage following the first output voltage of said first buffer circuit and outputs this as the adjusted operational power source voltage to said supplied circuit.

2. A voltage generating circuit according to claim 1, wherein said variable delay circuit includes m number, where m is an integer, of gate circuits connected in series.

3. A voltage generating circuit according to claim 2, wherein said supplied circuit is a logic circuit and said integer m is set to be larger than a maximum design number of gates l, where l is an integer, of the logic circuit.

4. A voltage generating circuit according to claim 1, wherein said voltage generating means further includes an integrating means for controlling the first output voltage in response to the result of comparison from said phase comparison circuit.

5. A voltage generating circuit according to claim 1, wherein said voltage generating means has a counting means for setting a count value in response to the result of comparison from said phase comparison circuit and a digital/analog converting means for outputting a voltage signal in response to the count value of said counting means.

6. A voltage generating circuit according to claim 1, further comprising a frequency dividing circuit for dividing the frequency of said clock signal wherein the frequency divided signal from said frequency dividing circuit is given a delay time by said variable delay circuit and is output as a comparison signal to said phase comparison circuit and an inverted signal of said frequency divided signal is output as a reference signal to said phase comparison circuit.

7. A voltage generating circuit according to claim 6, wherein said frequency dividing circuit is a ½ frequency dividing circuit constituted by a flip-flop.

8. A voltage generating circuit for supplying an adjusted operational power source voltage to a supplied circuit in response to a frequency of an input clock signal, comprising:

a variable delay circuit for delaying the input clock signal by exactly a delay time in response to the operating power source voltage;

a fixed delay circuit for delaying by exactly a delay time set in advance and outputting the delayed clock signal output from said variable delay circuit;

a phase comparison circuit performing a comparison of phases of the clock signal delayed by said fixed delay circuit and said input clock signal; and a voltage generating means for adjusting the level of an output voltage in response to the result of comparison of said phase comparison circuit and supplying the output voltage as the adjusted operating power source voltage to said variable delay circuit and to said supplied circuit wherein said fixed delay circuit has a delay time equivalent to the delay time of the maximum delay path of said supplied circuit.

9. A voltage generating circuit according to claim 8, wherein said fixed delay circuit includes a substrate circuit equivalent to the maximum delay path of said supplied circuit.

10. A voltage generating circuit according to claim 8, wherein said voltage generating means further includes an integrating means for controlling the output voltage in response to the result of comparison from said phase comparison circuit.

11. A voltage generating circuit for supplying an adjusted operational power source voltage to a supplied circuit in response to a frequency of an input clock signal, comprising:

a variable delay circuit for delaying the input clock signal by exactly a delay time in response to the operational power source voltage;

a phase comparison circuit performing a comparison of phases of the clock signal delayed by said variable delay circuit and said input clock signal; and a voltage generating means for adjusting the level of an output voltage in response to the result of comparison of said phase comparison circuit and supplying the output voltage as the adjusted operational power source voltage to said variable delay circuit and to said supplied circuit wherein said voltage generating means further comprises a frequency dividing circuit for dividing the frequency of said clock signal wherein said frequency divided signal from said frequency dividing circuit is given a delay time by said variable delay circuit and is output as a comparison signal to said phase comparison circuit and an inverted signal of said frequency divided signal is output as a reference signal to said phase comparison circuit.

12. A voltage generating circuit according to claim 11, wherein said frequency dividing circuit is a ½ frequency dividing circuit constituted by a flip-flop.

13. A voltage generating circuit according to claim 11, wherein said voltage generating means has a counting means for setting a count value in response to the result of comparison from said phase comparison circuit and a digital/analog converting means for outputting a voltage signal in response to the count value of said counting means.

14. A voltage generating circuit for supplying an adjusted operational power source voltage to a supplied circuit in response to a frequency of an input clock signal, comprising:

a variable delay circuit for delaying the input clock signal by exactly a delay time in response to the operating power source voltage;

a phase comparison circuit performing a comparison of phases of the clock signal delayed by said fixed delay circuit and said input clock signal; and a voltage generating means for adjusting the level of an output voltage in response to the result of comparison of said phase comparison circuit and supplying the output voltage as the adjusted operating power source voltage to said variable delay circuit and to said supplied circuit wherein said delay time of said variable delay circuit is set to be larger than a maximum delay time of the supplied circuit.

15. A voltage generating circuit according to claim 14, wherein said variable delay circuit includes m number, where m is an integer, of gate circuits connected in series.

16. A voltage generating circuit according to claim 15, wherein said supplied circuit is a logic circuit and said integer m is set to be larger than a maximum design number of gates l, where l is an integer, of the logic circuit.

17. A voltage generating circuit according to claim 14, wherein said voltage generating means further includes an integrating means for controlling the output voltage in response to the result of comparison from said phase comparison circuit.

18. A voltage generating circuit according to claim 14, wherein said voltage generating means has a counting means for setting a count value in response to the result of comparison from said phase comparison circuit and a digital/analog converting means for outputting a voltage signal in response to the count value of said counting means.

19. A voltage generating circuit according to claim 14, further comprising a frequency dividing circuit for dividing the frequency of said clock signal wherein the frequency divided signal from said frequency dividing circuit is given a delay time by said variable delay circuit and is output as a comparison signal to said phase comparison circuit and an inverted signal of said frequency divided signal is output as a reference signal to said phase comparison circuit.

20. A voltage generating circuit according to claim 19, wherein said frequency dividing circuit is a ½ frequency dividing circuit constituted by a flip-flop.

* * * * *